US005762010A

United States Patent [19]

De Muynck

[11] Patent Number: 5,762,010

[45] Date of Patent: Jun. 9, 1998

[54] METHOD AND DEVICE FOR PROCESSING WASTE HAVING A CALORIFIC VALUE

[75] Inventor: José Omer Arnold De Muynck, Wingene, Belgium

[73] Assignees: Groep Danis, Naamloze Vennootschap; Norbert Druwel, both of Belgium

[21] Appl. No.: 750,778

[22] PCT Filed: Jun. 20, 1995

[86] PCT No.: PCT/BE95/00058

§ 371 Date: Dec. 20, 1996

§ 102(e) Date: Dec. 20, 1996

[87] PCT Pub. No.: WO95/35352

PCT Pub. Date: Dec. 28, 1995

[30] Foreign Application Priority Data

Jun. 21, 1994 [BE] Belgium ..... 9400593

[51] Int. Cl.[6] ..... F23G 5/00

[52] U.S. Cl. ..... 110/346; 110/224; 110/229; 110/238; 432/27; 432/28; 432/215

[58] Field of Search ..... 110/346, 224, 110/229, 245, 238; 432/27, 28, 197, 214, 215

[56] References Cited

U.S. PATENT DOCUMENTS

| | | | |
|---|---|---|---|
| 2,837,586 | 6/1958 | Hepp | 432/27 X |
| 4,153,411 | 5/1979 | Isheim | 432/27 |
| 4,193,758 | 3/1980 | Peterson et al. | 432/27 |
| 4,218,288 | 8/1980 | Theodore . | |
| 4,232,614 | 11/1980 | Fitch et al. | 110/224 X |
| 4,248,164 | 2/1981 | Isheim . | |
| 4,449,461 | 5/1984 | Gorbulsky | 110/229 |
| 4,597,737 | 7/1986 | Raghavan et al. | 432/197 |
| 5,297,957 | 3/1994 | Brashears | 432/28 X |

FOREIGN PATENT DOCUMENTS

| | | |
|---|---|---|
| 485255 | 5/1992 | European Pat. Off. . |
| 849838 | 7/1952 | Germany . |
| 960892 | 3/1957 | Germany . |
| 160423 | 8/1921 | United Kingdom . |

*Primary Examiner*—Henry A. Bennett
*Assistant Examiner*—Susanne C. Tinker
*Attorney, Agent, or Firm*—Bacon & Thomas

[57] ABSTRACT

A thermal method for continuously processing waste having a calorific value and any degree of moisture, wherein waste is put in a flow of hot, heat-resistant, heat-exchanging material which is warmer than 100° C. The heat exchanging material cools due to heat exchange, the waste dries and the non-evaporated waste components are heated. The cooled, heat-exchanging material is subsequently separated from the dried waste materials and the separated dried waste material is mixed with a percentage of the separated heat-exchanging material. The dried waste material and heat-exchanging material mixture is subsequently heated to pyrolyze waste material and heat the heat exchanging material in preparation for its subsequently use in the continuous process.

15 Claims, 1 Drawing Sheet

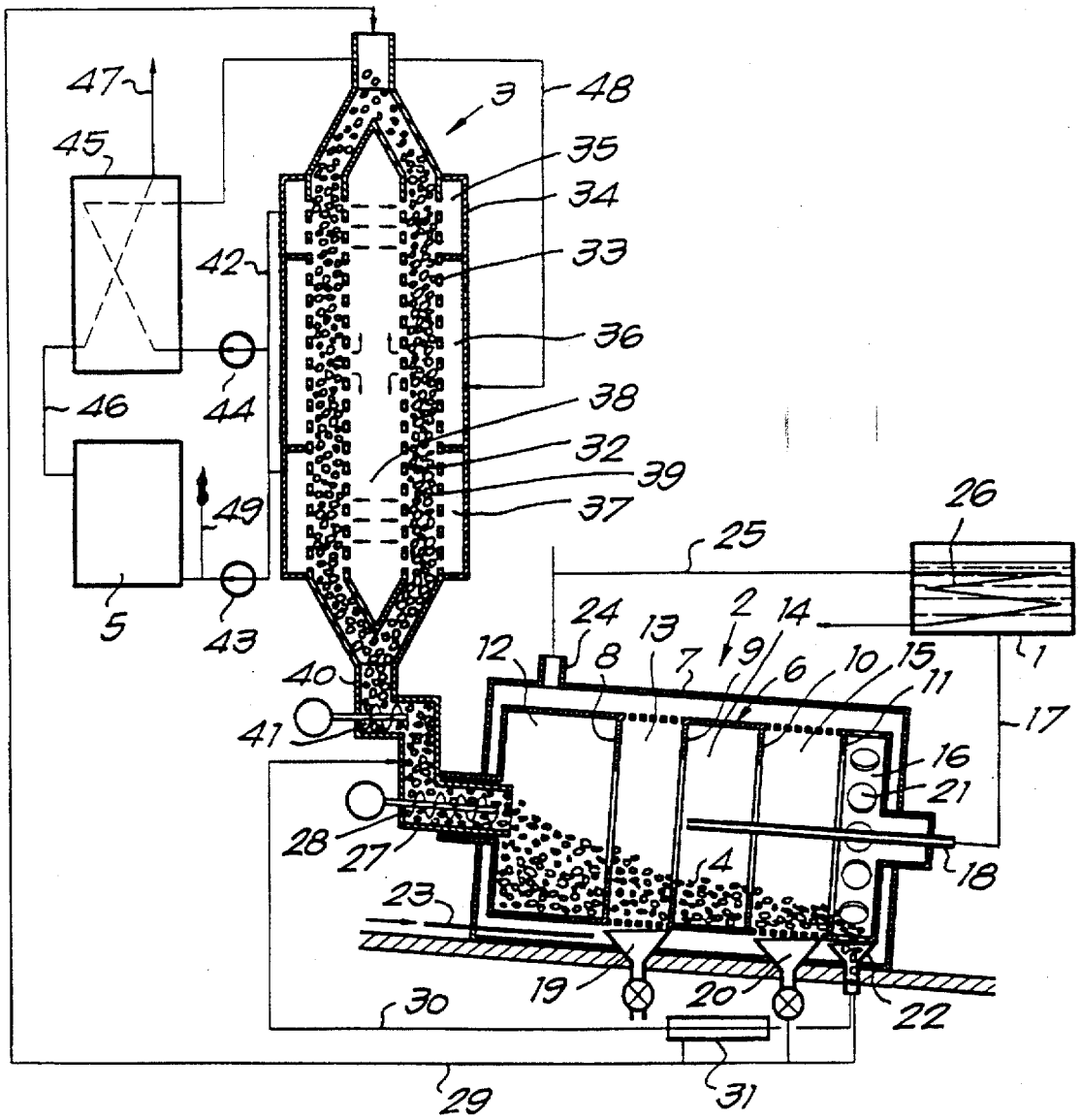
47
45
3
48
35
34
33
42
36
46
44
38
32
39
37
49
26
25
5
43
24
2
14
13
12
8
7
9
6
10
15
11
1
40
41
17
16
21
28
27
4
18
23
19
20
22
30
29
31

METHOD AND DEVICE FOR PROCESSING WASTE HAVING A CALORIFIC VALUE

BACKGROUND OF THE INVENTION

1. Field of the Invention

The invention relates to a method for processing waste having a calorific value and any degree of humidity.

2. Discussion of Technology

The general process involved in this invention comprises a thermal treatment, wherein waste is put in a flow of hot, heat-resistant, heat-exchanging material which is warmer than 100° C. The material cools due to heat exchange, the waste dries and the non-evaporated waste components are heated. The cooled, heat-exchanging material is subsequently separated from the dried waste material, and at least a part of the separated dried waste material is mixed with a percentage of the separated heat-exchanging material. The dried waste material and heat-exchanging material mixture is subsequently heated, and the dried waste material is pyrolyzed, resulting in its final burning. The heat-exchanging material is thus heated before further use in the thermal treatment.

More particularly, the invention relates to the processing of somewhat viscous waste containing organic material, including solids and/or liquids. For example, waste of animal origin, waste from slaughterhouses, sludge from the cellulose and paper industry, rancid oils, etc. or waste containing combustible mineral components may be processed using the method. The largest size of the solid waste particles is preferably smaller than 5 mm.

A method of the above-mentioned type is described in U.S. Pat. No. 4,248,164. According to this method, the fresh waste is dried using hot sand. The dried waste and the cooled sand are removed together from the drying installation and are separated. The separated dried waste is subjected to a pyrolysis, usually with the help of burners, in a combustion chamber. The separated sand is heated by the gases of the pyrolysis before being supplied to the drying installation. All of the sand which is used for the drying is recycled and supplied back to said drying installation at a temperature between 427° and 649° C. (800°–1200° F.).

When the hot sand makes contact with fresh, cold waste, the very great thermal shock causes the sand grains to burst. Because sand is used, the heat-exchange capability is limited. The high temperature in the drying installation limits the life of the drying installation unless it is made of special materials, which makes this process expensive.

GB-A-160,422 describes a method for drying material which needs to be ground in a revolving drum. The grinding elements (balls) from the drum are collected and are carried back into the drum via a tube in which they are heated by a furnace. However, the material is not waste and is not pyrolyzed after the drying.

The present invention aims to remedy said disadvantages and to provide a method for processing waste having a calorific value which has a high thermal efficiency and a maximum utilization of the processed waste. The present invention also aims to provide a method which is ecologically sound and can be realized with a relatively inexpensive device having a long life.

SUMMARY OF THE INVENTION

In reaching this aim according to the invention, a granulated material used as heat-exchanging material is heated. Fresh waste material is introduced into the flow of the heated granulated material, thereby drying the waste material. The dried waste material and granulated material are then separated. The dried waste material separated from the granulated material is mixed with only a part of the separated, cooled granulated material. This first mixture is pyrolyzed. The remaining part of the separated, cooled granulated material is mixed with the granulated material heated by the pyrolysis. This second mixture is used to dry fresh waste.

Preferably, the dried waste material and the granulated material are substantially separated from one another by collecting them separately after the drying.

Preferably, all the separated dried waste material is mixed with only a part of the separated granulated material.

In order to further diminish the thermal shock to the granulated material, it is recommended to preheat the waste before introduction into the flow of the heated granulated material. For example, fresh waste may be preheated through heat exchange using steam released as previously introduced waste is dried.

The present invention also contemplates a device for processing waste having a calorific value and any degree of humidity. The device includes a horizontal drying installation having a drying compartment. A waste supply pipe supplies fresh waste to the drying compartment. A heating installation for pyrolzing dried waste material and heating granulated material supplies pyrolyzed waste material and heated granulated material to the drying installation through a conveyor outlet pipe. Means for collecting dried waste material and granulated material from the drying compartment collect each material substantially separately. A first supplying means supplies at least part of the dried waste material and at least part of the granulated material from the collecting means to the heating installation. A second supplying means supplies at least part of the granulated material from the collecting means to the conveyor outlet pipe.

Preferably, the drying installation contains an ash removal compartment arranged such that ashes produced during the pyrolysis of the waste material are removed from the granulated material before reaching the drying compartment. The removal may be via openings in a drum wall.

The heating installation includes an inner cylinder which is coaxial with an outer cylinder. The cylinders define an interspace for receiving the dried waste material and the granulated material from the first supplying means. A chamber surrounds both cylinders. The chamber communicates with an incinerator and a heat exchanger.

BRIEF DESCRIPTION OF THE DRAWING

In order to better explain the characteristics of the invention, the following preferred embodiment of a method and a device for processing waste having a calorific value is given as an example and without being limitative in any way, reference being made to the accompanying drawing, in which:

FIG. 1 shows a schematic, partially sectioned view of a waste processing device according to the invention.

DETAILED DESCRIPTION OF THE PREFERRED EMBODIMENT

The figure shows a device for processing industrial sludge, for example, with 10% dry components having a calorific value of some MJ/kg, for example 15 MJ/kg.

The device contains a reservoir 1 for storing the waste material to be processed, a drying installation 2 with which reservoir 1 is connected, and a heating installation 3 which is connected to drying installation 2 for heating granulated material 4. An incinerator 5 and a heat exchanger 45 are connected to heating installation 3. Granulated material 4 consists of heat-resistant granules which are resistant to temperatures required for the pyrolysis of the waste, preferably to temperatures above 850° C., and which have a high thermal conductivity.

The granulated material preferably consists of ceramic material. Suitable materials are, for example, burnt clay or calcium aluminate with an aluminum alloy that depends on the temperature. The radiation capacity of such materials is usually about 201 2/$M^2$. °K. h.

The size of the grains is, for example, such that they are detained by a sieve with meshes of 9×9 mm, but can pass through a sieve with meshes of 11×11 mm.

The specific surface of the grains must be as large as possible. For grains made of the above-mentioned materials and with the above-mentioned size, this specific surface is about 750 $m^2/m^3$.

Drying installation 2 has the shape of a horizontal, slightly inclined drum dryer which contains an actual drum 6 which is mounted rotatable about its axis surrounded by a thermally and acoustically insulating jacket 7. Drum 6 is divided into five compartments by internal ring-shaped partitions 8, 9, 10 and 11. Seen from the most elevated end of drum 6, sequentially these compartments are a homogenization compartment 12, an ash removal compartment 13, a drying compartment 14, a separation compartment 15 for separating out the dried waste components and a granulated material discharge compartment 16.

Reservoir 1 connects to drying compartment 14 via a waste pipe 17 and a waste supply pipe 18. The wall of drum 6 is provided with openings at the height of ash removal compartment 13, so that it forms a sieve through which ashes, but not granulated material 4, pass. In order to collect the ashes, an ash funnel 19 is mounted under this wall section of the drum.

In an analogous manner, the wall of drum 6 is provided with openings at the height of separation compartment 15, so that the corresponding wall part forms a sieve through which dried waste material, but not granulated material 4, passes. In order to collect the waste material, a waste funnel 20 is mounted under this wall section of the drum.

Granulated material discharge compartment 16 situated at the least elevated end and is provided with openings 21 through which granulated material 4 passes. In order to collect the granulated material, a granulated material funnel 22 is mounted under this wall section of the drum.

A number of air supply lines 23 open into jacket 7. Jacket 7 is provided at its highest point with a steam outlet 24 which connects via a steam pipe 25 to a serpentine curve situated in reservoir 1 which forms a heat exchanging pipe 26.

At the most elevated end of drum 6, a conveyor outlet pipe 27 is connected for supplying granulated material 4. Conveyor outlet pipe 27 has an internal conveyor outlet screw 28.

Granulated material funnel 22 is connected via a combined return pipe 29 to the top of vertically erected heating installation 3. A lift mechanism, which is not represented in the figure, is mounted inside combined return pipe 29. Granulated material funnel 22 is also connected via a granulated material return pipe 30 to conveyor outlet pipe 27. Another lift mechanism, also not represented in the figure, and a sieve 31 are mounted inside granulated material return pipe 30. Waste funnel 20 opens into combined return pipe 29. Sieve 31 also opens into combined return pipe 29. Together with partition 11 and the sieve-forming wall parts of drum 6, waste funnel 20 and granulated material funnel 22 form means to collect the granulated material and dried waste material separately.

Heating installation 3 includes a perforated inner cylinder 32 which is coaxial with a perforated outer cylinder 33. Cylinders 32 and 33 are situated vertically in a chamber 34 which is divided into three compartments 35, 36 and 37 around the outer cylinder 33.

A space 38 inside the inner cylinder 32 is closed at the top and at the bottom. A ring-shaped interspace 39 between cylinders 32 and 33 opens at the top into a common entry to which combined return pipe 29 is connected. Interspace 39 opens at the bottom into a conveyor pipe 40. Conveyor pipe 40 has an internal conveyor screw 41 and is connected to conveyor outlet pipe 27.

Top compartment 35 and bottom compartment 37 connect via a heat exchanger return pipe 42 over a first fan 43 to incinerator 5 and over a second fan 44 to a secondary part of heat exchanger 45. Incinerator 5 is connected to a primary part of heat exchanger 45. This primary part opens into an outlet 47. The secondary part of heat exchanger 45 is connected via a heat exchanger supply pipe 48 to middle compartment 36 of heating installation 3.

At the end of heat exchanger return pipe 42 which connects to incinerator 5, an open burner 49 is connected.

The above-described device works as follows:

In reservoir 1, a mixture of waste having different calorific values is stored so as to be able to guarantee the heat required for the method. Any solid or liquid waste mixture can be processed by the present invention. However, by mixing different sorts of waste, one can make sure that the waste has enough calorific value to supply the heat required to preserve the method without requiring any fuel from outside the device after start-up. The more solid components the waste contains, the higher the calorific value. In reservoir 1, the waste mixture is heated to about 800° C. by means of heat exchange with the steam which is generated during the drying of the waste and which flows through heat exchanging pipe 26.

The preheated waste is supplied via waste pipe 17 and waste supply pipe 18 to drying compartment 14 of drying installation 2, whose drum 6 is continuously rotated. Here, the waste is exposed to hot granulated material 4 which is moved in drum 6 from the most elevated end to the least elevated end. This granulated material has a temperature between 200°and 300° C., for example a temperature of about 250° C., when it arrives over ring-shaped partition 9 in drying compartment 14.

Due to heat exchange the waste dries, whereby the dried waste material is heated to 100° C. or more and the granulated material cools to preferably the same temperature. From the mixture of cooled granulated material and dried waste components which end up in separation compartment 15 over ring-shaped partition 10, the dried waste material is separated as it falls through a sieve-forming wall section of drum 6. The waste material is collected in waste funnel 20 and subsequently supplied to combined return pipe 29.

Practically only granulated material falls over the overflow formed by smaller, ringshaped partition 11 into granulated material discharge compartment 16 from where it falls through openings 21 and into granulated material funnel 22.

The major part of granulated material 4, normally 75 to 85 wt %, for example 80 wt %, is directly supplied to conveyor outlet pipe 27 via granulated material return pipe 30 after it has been purified by removal of waste material using sieve 31. By means of conveyor outlet screw 28, this part of the granulated material is mixed with the mixture of hot granulated material and ashes coming from heating installation 3 at a temperature of about 750° C. This second mixture is advanced into homogenization compartment 12, where the mixing continues. In homogenization compartment 12, the difference between the temperatures of the core and the outside of the granules of the granulated material drops below 40° K, and the average temperature of the mass of granulated material is brought between 200° to 300° C., for example to about 250° C. From the homogenous mixture which falls over partition 8 into ash separation compartment 13, the ashes are removed as they fall through another sieve-forming wall section of drum 6. These ashes are collected in ash funnel 19.

Practically pure granulated material 4 with an average temperature of about 250° C. falls over partition 9 into drying compartment 14.

The part of the waste material which is removed from granulated material return pipe 30 by means of sieve 31 is added to the waste material and granulated material in combined return pipe 29.

A smaller part of granulated material 4, between 15 and 25 wt %, for example 20%, is supplied through combined return pipe 29 by a lift mechanism, not represented here, after waste material from waste funnel 20 and sieve 31 are added, to interspace 39 of heating installation 3. In interspace 39, the mixture of granulated material and waste material falls due to the force of gravity.

In the middle zone of interspace 39, heated air at a temperature of about 750° C., coming from the secondary part of heat exchanger 45, is introduced via heat exchanger supply pipe 48 and middle compartment 36. The supplied air flows from middle compartment 36 to the middle zone of interspace 39 through cylinders 33 and 32 and thus through the material therein. This air causes the pyrolysis and the final burning of the waste material which is mixed with the granulated material.

Part of the gases coming from the middle zone flows upward in space 38 and through the top zone of interspace 39.

The gasification and the first pyrolysis of the waste material takes place in the top zone of interspace 39, whereby a gaseous fuel is produced of relatively inferior quality. This gaseous fuel is removed via top compartment 35 and carried via heat exchanger return pipe 42 by means of fans 43 and 44, partly to incinerator 5 and partly to the secondary part of heat exchanger 45.

Another part of the gases coming from the middle zone flows downward in space 38 and subsequently through the lower zone of interspace 39. The final combustion of all combustible elements in the waste material takes place in this lower zone. Also, the temperature variations in the granulated material are attenuated in this lower zone. The gases from this lower zone are collected in bottom compartment 37, from where they are mainly supplied to incinerator 5 and to a lesser extent to the secondary part of heat exchanger 45 via heat exchanger return pipe 42 by means of fans 43 and 44.

The mixture of granulated material and ashes is removed from the bottom of heating installation 3 and is carried through conveyor pipe 40 to conveyor outlet pipe 27 at a temperature of about 750° C. by means of a conveyor screw 41.

The mixture of gases at about 300° C. from top compartment 35 and the air, 30 to 40% of which is partly polluted by combustion gases from the lower one in interspace 39, at about 750° C. from bottom compartment 37, are burnt in the incinerator 5. Any surplus of these gases is burnt in open burner 49.

The combustion gases of incinerator 5 at a temperature of about 850° C. are carried via a connection pipe 46 to the primary part of heat exchanger 45 where the air supplied to the middle compartment 36 is heated to about 750° C. Heat exchanger 45 provides the necessary pressure and under pressure for the working of the heating installation 3, incinerator 5, and heat exchanger 45 combination as a whole.

In order to start the device, a high-grade fuel is supplied and combusted in incinerator 5. As soon as the temperature of the granulated material which is collected from drying installation 2 is higher than 100° C., waste is gradually supplied to drying installation 2. As soon as hot granulated material is supplied to drying installation 2 at a temperature of 200° to 250° C., the normal flow of waste can be supplied. In the meantime, the supply of fuel to incinerator 5 is reduced to zero. This starting procedure requires one hour at the most.

The steam which is produced during the drying in drying installation 2 and collected via steam outlet 24 can be partly used for preheating the waste. Any surplus of steam can be efficiently used for heating water for domestic use. Depending on the composition, the condensate of this steam can be chemically neutralized or mixed with 5 vol. % preheated air and heated up to 800° C. in a regeneration heat exchanger, not shown in the figure, which works uninterruptedly with granulated material. The thermal agent of the heater is the heater agent itself after a flow of gaseous fuel has been led through it, coming, for example, from the top zone of heating installation 3. The fuel is burnt and the air is dispersed in the steam mass. During the period in which the steam has a high temperature, the oxidizing effect of the air contributes to the detoxication of the steam.

In order to prevent condensate from forming inside jacket 7, hot air can be blown through air supply lines 23 in jacket 7. This air can be heated by heat exchanger 45.

According to the above-described method and with the above-described device, a complete treatment of all harmful materials in the processed waste is obtained. The potential energy which is stored in the waste is efficiently utilized. Only in the case of waste with a high degree of humidity must fuel be added from outside the device. In the case of relatively dry waste, for example waste which contains 25% water and has a heating value of more than 2 MJ/kg, fuel from outside is not even required. Additional fuel is required only when starting or re-starting the device, but even then the consumption is relatively low. The steam produced is entirely utilized. The ashes can be directly collected via ash funnel 19 and do not disperse in the gases. The collected ashes have a temperature of only 200° C., which indicates that the considerable heat of these ashes has been fully used in this device.

The intensive heat transfer of the granulated material allows for an inexpensive, compact and very efficient device.

The present invention is by no means limited to the embodiments described above and represented in the accompanying drawing; on the contrary, such a method and device for processing waste can be realized in all sorts of variants while still remaining within the scope of the invention.

I claim:

1. A method for processing waste having a calorific value and any degree of humidity, comprising the steps of:

heating a granulated heat-exchanging material and establishing a flow of the heated heat exchanging material;

introducing a flow of waste material into the flow of the heated heat exchanging material such that the waste material is heated and dried and the granulated material is cooled;

separating the dried waste material and the cooled heat exchanging material;

forming a first mixture of at least part of the dried waste material and a portion of the cooled heating exchanging material;

pyrolyzing the first mixture such that the dried waste material is burned to ashes and the heat exchanging material is reheated;

forming a second mixture of the reheated heat exchanging material and the remaining portion of the cooled heating exchanging material; and feeding the second mixture as a heat-exchanging material into the flow of heat exchanging material to dry the flow of waste material in a continuous process.

2. The method according to claim 1, wherein the dried waste material and the cooled heat exchanging material are substantially separated by collecting them separately.

3. The method according to claim 1, including combusting gases released during pyrolysis, and using heat produced from the combustion for the pyrolyzing.

4. The method according to claim 1, wherein the first mixture is formed of all of the dried waste material and only part of the cooled heat exchanging material.

5. The method according to claim 1, including preheating the waste material before introducing it into the flow of the heated heat exchanging material.

6. The method according to claim 5, wherein the preheating of the waste material is carried out by heat exchange with steam released from the drying of previously introduced waste material.

7. The method according to claim 1, including reheating the heat exchanging material of the first mixture during the pyrolysis to 250° to 300° C. such that the second mixture is heated to a temperature of 200° to 300° C.

8. Apparatus for processing waste having a calorific value and any degree of humidity, comprising:

a horizontal waste drying installation (2) having a drying compartment (14);

a waste supply pipe (18) which supplies a flow of fresh waste to the drying compartment (14);

a heating installation (3) for receiving dried waste material from the drying installation, for pyrolyzing said dried waste material and for heating heat exchanging material, the heating installation (3) including a conveyor outlet pipe (27) supplying pyrolyzed waste material and heated heat exchanging material to the waste drying installation (2) from the heating installation;

means for collecting (20, 22) dried waste material and heat exchanging material substantially separately from the drying compartment (14);

a first means for supplying (29) at least part of the dried waste material and at least part of the heat exchanging material from the collecting means (20, 22) to the heating installation (3); and a second means for supplying (30) at least part of the heat exchanging material from the collecting means (20, 22) to the conveyor outlet pipe (27) for return to the waste drying installation.

9. The apparatus according to claim 8, further comprising:

an incinerator (5) which receives and combusts gases released during the pyrolysis in the heating installation (3); and a heat exchanger (45) which uses heat from the combustion in the incinerator (5) for pyrolyzing dried waste material and heating heat exchanging material in the heating installation (3).

10. The apparatus according to claim 8, further comprising:

a homogenization compartment (12) within the drying installation (2) which communicates between the conveyor outlet pipe (27) and the drying compartment (14) and homogeneously mixes the heat exchanging material supplied by the second supplying means (30) with the heated heat exchanging material from the heating installation (3).

11. The apparatus according to claim 8, further comprising:

an ash removal compartment (13) within the drying installation (2) arranged to remove ashes produced by the pyrolysis of the waste material from the heat exchanging material before the heat exchanging material reaches the drying compartment (14).

12. The apparatus according to claim 8, wherein the drying installation includes a horizontal drum (6) which is rotatable about its horizontal axis, the drum (6) being divided into compartments (12, 13, 14, 15, 16) including the drying compartment (14) by internal ring-shaped partitions (8, 9, 10, 11), and a jacket (7) which surrounds the drum (6).

13. The apparatus according to claim 12, further comprising:

a steam outlet (24) connected to the jacket (7); and a heat-exchanging pipe (26) communicating with the steam outlet (24) such that the waste material flow is preheated before being supplied to the waste drying compartment (14).

14. The apparatus according to claim 9, wherein the heating installation (3) is a vertical heating installation comprising:

an inner cylinder (32) which is coaxial with an outer cylinder (33), thereby defining an interspace (39) which receives the dried waste material and the heat exchanging material from the first supplying means (29); and a chamber (34) which surrounds both cylinders and communicates with the incinerator (5) and the heat-exchanger (45).

15. The apparatus according to claim 14, wherein the chamber (34) is divided into a top compartment (35), a middle compartment (36) and a bottom compartment (37) around the outer cylinder (33), the top compartment (35) and the bottom compartment (37) arranged to supply gases released during the pyrolysis to the incinerator (5) for combustion, and the middle compartment (36) arranged to receive heat from the heat exchanger (45) for pyrolyzing dried waste material and heating heat exchanging material in the heating installation (3).

* * * * *